United States Patent [19]

Bousquet et al.

[11] Patent Number: 4,756,819

[45] Date of Patent: Jul. 12, 1988

[54] PROCESS FOR THE THERMAL TREATMENT OF HYDROCARBON CHARGES IN THE PRESENCE OF ADDITIVES WHICH REDUCE COKE FORMATION

[75] Inventors: Jacques Bousquet, Irigny; Thierry Barbou des Courieres, Lyons; Jean Pierre Mermoz, Venissieux, all of France

[73] Assignee: Elf France, Paris, France

[21] Appl. No.: 673,325

[22] Filed: Nov. 19, 1984

[30] Foreign Application Priority Data

Nov. 21, 1983 [FR] France ..... 83 18495

[51] Int. Cl.[4] ..... C10G 9/16

[52] U.S. Cl. ..... 208/48 AA; 208/48 R; 208/106; 208/113; 208/121; 208/107; 208/112; 208/251 H; 208/251 R; 585/950; 252/8.3

[58] Field of Search ..... 208/106, 113, 121, 251 R, 208/251 H, 48 AA, 107, 112, 48 R; 585/950

[56] References Cited

U.S. PATENT DOCUMENTS

| | | | |
|---|---|---|---|
| 1,894,770 | 1/1933 | Jennings | 208/112 |
| 2,471,131 | 5/1949 | Viles | 208/113 |
| 3,161,584 | 12/1964 | Gleim | 208/251 H |
| 3,161,585 | 12/1964 | Gleim et al. | 208/251 H |
| 3,252,894 | 5/1966 | Gatsis et al. | 208/254 H |
| 3,293,172 | 12/1966 | Gleim | 208/251 H |
| 3,297,589 | 1/1967 | Gleim | 208/251 H |
| 3,558,474 | 1/1971 | Gleim et al. | 208/213 |
| 3,567,623 | 3/1971 | Hagney | 208/48 AA |
| 3,617,503 | 11/1971 | Rogers et al. | 208/112 |
| 3,657,111 | 4/1972 | Gleim | 208/213 |
| 3,776,835 | 12/1973 | Dvoracek | 208/48 AA |
| 3,919,073 | 11/1975 | Bagnoli et al. | 208/48 R |
| 4,169,041 | 9/1979 | Schuette | 208/112 |
| 4,216,076 | 8/1980 | Dillion et al. | 208/48 AA |
| 4,285,804 | 8/1981 | Jacquin et al. | 208/112 |
| 4,290,919 | 9/1981 | McKay et al. | 208/52 CT |
| 4,313,818 | 2/1982 | Aldridge et al. | 208/113 |
| 4,343,658 | 8/1982 | Baker et al. | 208/48 R |
| 4,370,220 | 1/1983 | Bearden et al. | 208/113 |
| 4,370,221 | 1/1983 | Patmore et al. | 208/112 |
| 4,409,093 | 10/1983 | Bearden, Jr. et al. | 208/113 |
| 4,430,207 | 2/1984 | Kukes | 208/251 R |
| 4,457,835 | 7/1984 | Kukes | 208/251 H |
| 4,483,762 | 11/1984 | Crosboll | 208/251 H |
| 4,507,196 | 3/1985 | Reed et al. | 208/106 |
| 4,549,958 | 10/1985 | Beck et al. | 208/251 R |
| 4,612,110 | 9/1986 | Kukes et al. | 208/251 H |

FOREIGN PATENT DOCUMENTS

| | | | |
|---|---|---|---|
| 48505 | 5/1985 | European Pat. Off. | 208/251 H |
| 15480 | 1/1984 | Japan | 208/48 R |

*Primary Examiner*—Helen M. S. Sneed
*Assistant Examiner*—Helane Myers
*Attorney, Agent, or Firm*—Burgess, Ryan & Wayne

[57] ABSTRACT

This invention concerns a process for the thermal treatment of hydrocarbon charges having a high content of asphaltenes in the presence of additives which prevent coke formation. The additive according to the invention is a salt of a metal selected from V, Mo, Cr, W, Fe, Co and Ni at a concentration between 100 and 2500 ppm of metal relative to the charge either in the form of a suspension of solid particles, in solution or as an emulsion. These additives prevent the coke formation in all thermal treatments of which the temperature is above about 420° C., such as viscoreduction or hydro viscoreduction.

13 Claims, 1 Drawing Sheet

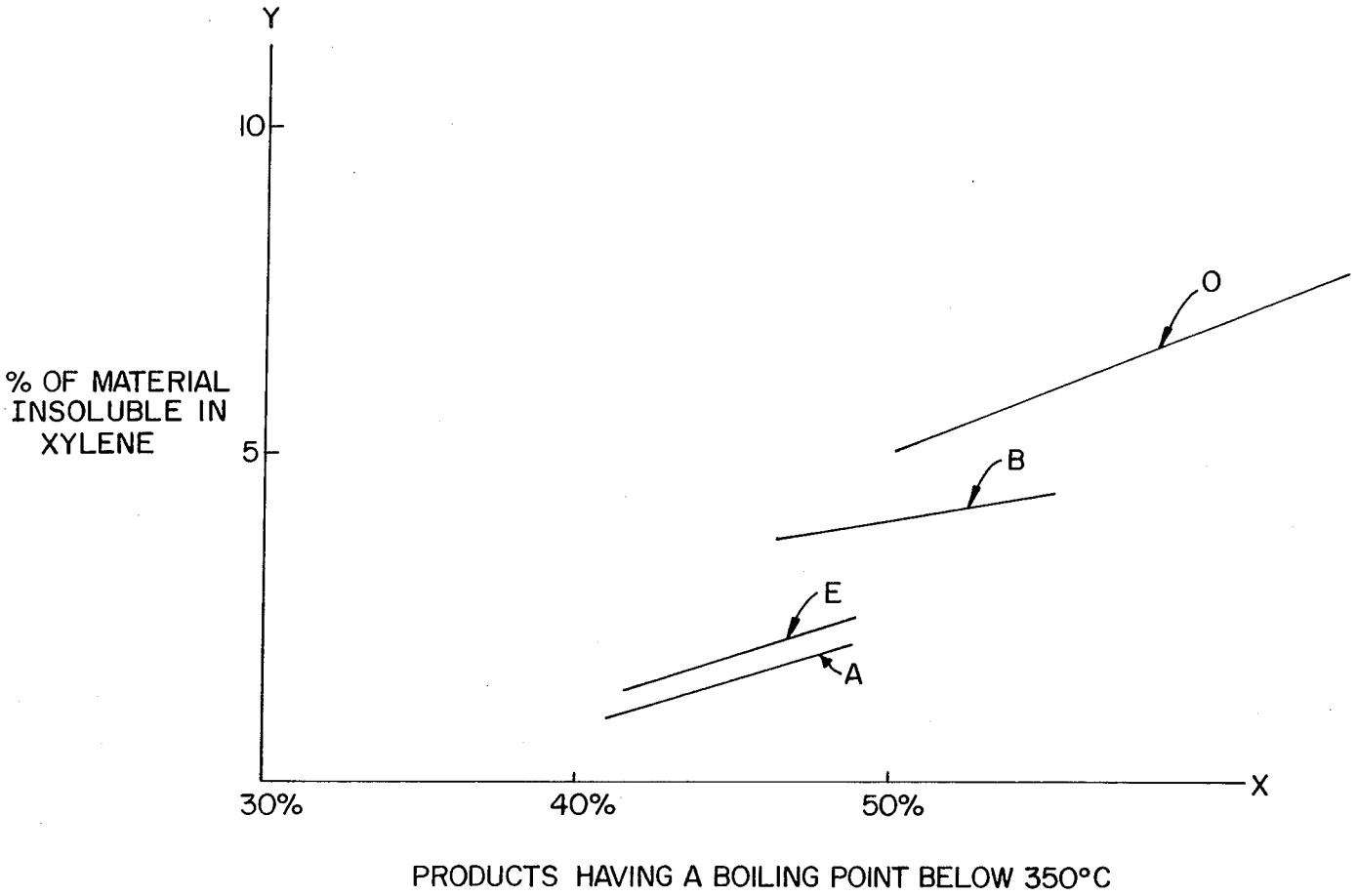
Y
10
5
% OF MATERIAL INSOLUBLE IN XYLENE
O
B
E
A
30%
40%
50%
X
PRODUCTS HAVING A BOILING POINT BELOW 350°C

PROCESS FOR THE THERMAL TREATMENT OF HYDROCARBON CHARGES IN THE PRESENCE OF ADDITIVES WHICH REDUCE COKE FORMATION

This invention concerns a process for the thermal treatment of hydrocarbon charges having a high content of asphaltenes in the presence of additives which prevent coke formation.

In processes for the thermal treatment of hydrocarbon charges, especially if the temperature is above about 420° C., free radicals are formed by cleavage of carbon-carbon and carbon-hydrogen bonds. These free radicals render the residues unstable and lead to the formation of coke by polymerisation.

The various known anti-coking additives simply have a dispersant effect on the coke which has already been formed but they do not prevent its formation. Even this dispersant effect is only apparent if the quantity of coke formed remains very small.

The anti-coking additives are selected depending on the operating conditions. Thus silicones and organic sulfides are used as coke deposition inhibitors in visco-reduction (Petrolite Corp. U.S. Pat. No. 4,116,812).

The heteropolyacids used in colloidal form and at high concentration, between 1 and 10% by weight, have a dispersant effect on the coke formed during the demetallisation of a heavy charge with a high pressure of hydrogen (UOP U.S. Pat. No. 3,252,894).

BRIEF DESCRIPTION OF THE INVENTION

There has now been found a process which permits the formation of coke to be reduced during thermal treatment of hydrocarbon charges with a high asphaltene content, consisting in submitting said charges to which have been added a small quantity of at least one metal compound, to temperatures from 350° to 500° C. and pressures from 1 to 100 bars. According to the invention this metal compound is a salt of a metal selected from V, Mo, Cr, W, Fe, Co and Ni. It is used at a concentration between 100 and 2500 ppm of metal relative to the charge.

The metal compound can be added to the charge in the form of a suspension of solid particles of metal sulphide.

It is also possible to use metal compounds which are soluble in the charge or even soluble in water or in an organic solvent. Aqueous or organic solutions form an emulsion with the charge.

DETAILED DESCRIPTION OF THE DRAWING

The FIGURE illustrates the relationship between the percent of material insoluble in xylene in relation to the amount of products having a boiling point below 350° C. in relation to the additives utilized in the present invention.

Among the compounds which are soluble in hydrocarbons, the salts formed with naphthenic or resinous acids are particularly suitable.

It is also possible to use bimetallic compositions, in which two sulphides, two soluble compounds or indeed a sulphide and a soluble compound are associated.

The effectiveness of the metal compounds is increased by addition of 0.05 to 5% by weight of the charge of dimethyl disulfide (DMDS) or of another organic sulphur compound having sulphide, disulphide, polysulphide, etc, groups.

The additives according to the invention may possibly be used in combination with supported catalysts.

The asphaltene content of the hydrocarbon charges to be treated, expressed as a Conradson carbon compound content, is generally between 5 and 25% without this range being restrictive with regard to the nature of the charges which can be treated by the present process.

The hydrocarbon charge having a high asphaltene content is mixed with metal sulphide particles in suspension or with a metal compound in solution or in the form of an emulsion, before being introduced into the reactor.

The temperature of the reactor can vary from 350° to 500° C., and is prefereably between 420° and 500° C.

The pressure can be chosen between 1 and 100 bars and is preferably between 5 and 25 bars. It results from hydrogen, nitrogen, water vapour, or a mixture thereof.

The additives according to the invention remain in suspension in the liquid effluent from the reactor. It may be economically attractive to separate them and recycle them.

The effectiveness of the treatment is followed by the progress of the percentage of sediments formed during the thermal treatment.

The quantity of sediments is expressed as a percentage of the total effluent. The sediments are extracted with xylene and the quantity of insoluble materials in the xylene is again expressed as a percentage of the total effluent.

The asphaltene is to be found in liquid effluent. It is dosed after percipitation with n-heptane according to the AFTNOR T 60 115 test. The Conradson carbon is measured by the AFTNOR T 60 116 test.

The following examples and the attached drawing illustrate the invention without however limiting it.

EXAMPLE 1

We treated a heavy Athabasca (crude) in the presence of various additives.

Characteristics of the crude

- Yield 350° C.−17.1% by weight
- Yield 350° C.+82.9% by weight
- Asphaltene n-$C_7$ 7.2% by weight
- Sulphur 4.5% by weight
- Nickel 75 ppm
- Vanadium 200 ppm
- $d^{15}_4$ 1.017

Additives Used

- Additive A—Nickel naphthenate having 5.8% nickel
- Additive B—molybdenum sulphide dispersed to 10% in oil
- Additive C—Ferric naphthenate with 5.2% iron
- Additive D—Vanadium naphthenate with 2.7% vanadium
- Additive E—Mixture of additives A and B.

The charge containing the additive was mixed with a stream of hydrogen before being introduced into the reactor. The operating conditions were as follows:

- Charge flow rate 400 ml/h
- Hydrogen flow rate 300 l/h (T.P.N.)
- Total pressure 80 bars
- LHSV—0.75 $h^{-1}$
- Temperature 440° C.

The effluent from the reactor was degassed in a high pressure separator followed by a low pressure separator.

The liquid effluent are centrifuged at 5400 rpm for 15 minutes in order to permit determination of the sediment content. The sediment was washed with xylene on an 0.8M milliporous filter which permitted determination of the content of materials insoluble in xylene.

The liquid effluent freed from insoluble material was then stripped of nitrogen. There was then determined the density ($d^{15}_4$), and the sulphur content, S(%), vanadium content V(ppm) and the content of asphaltene insoluble in n heptane (%). There was obtained by distillation the yields in fractions with boiling point below 350° C. (350° C.−) and above 350° C. (350° C.+).

The results are summarised in table 1, in which the concentrations of the additive are expressed as ppm of metal relative to the mixture of the Athabasca charge and the additive.

The influence of the additives will be better appreciated from a study of the attached drawing. In this drawing, the Y ordinate represents the evolution of materials insoluble in xylene (as a percentage of the total effluent), as a function, on the X abscissa, of the yield of products having a boiling point lower than 350° C. The straight lines A, E, B, and O are obtained, which correspond respectively to the additives A, E, and B and to a treatment without any additives. It will easily be observed that in an isoconversion process these additives reduce the production of materials insoluble in xylene, and it is nickel which is the most effective.

TABLE 1

| Additive | | | A | A | A | A | B | B | C | D | E | E |
|---|---|---|---|---|---|---|---|---|---|---|---|---|
| Concentration (ppm) | 0 | 0 | 571 | 571 | 1988 | 479 + 2% DMDS | 559 | 1941 | 497 | 340 | Ni 100 Mo 445 | Ni 345 Mo 1446 |
| $d_4^{15}$ | 0.928 | 0.934 | 0.952 | 0.945 | 0.965 | 0.951 | 0.950 | 0.944 | 0.951 | 0.949 | 0.943 | 0.948 |
| S (%) | 3.2 | 3.3 | 3.0 | 3.0 | 3.2 | 3.3 | 3.2 | 3.3 | 3.2 | 3.3 | 3.2 | 3.1 |
| V (ppm) | 47 | 70 | 123 | 169 | 165 | 189 | 69 | 90 | 134 | | 182 | 152 |
| Asphaltene % (n-heptane) | 2.1 | | 2.3 | 2.7 | | | 3.3 | 3.0 | 3.7 | 4.7 | 2.8 | 3.4 |
| Yield at 350° C. | 61.2 | 52.2 | 47.0 | 47.1 | 42.0 | 42.1 | 55.0 | 46.3 | 47.9 | 43.7 | 48.7 | 41.6 |
| Sediments (%) | 22 | 24 | 12 | 11 | 5 | 6 | 24 | 19 | 16 | 16 | 16 | 6 |
| Materials insoluble in xylene (%) | 7.2 | 5.5 | 2.3 | 1.5 | 1.2 | 1.1 | 4.4 | 3.7 | 2.6 | 2.8 | 2.5 | 1.4 |

EXAMPLE 2

We have tested the anti-coking effect of nickel naphthenate during a conventional viscoreduction because in this process the reaction temperature is limited by coke formation in the tubes.

| Characteristics of the crude | Laguna Once |
|---|---|
| Yield 350° C.− | 15.4% by weight |
| Yield 350–440° C. | 14.0% by weight |
| Yield 440° C.+ | 70.6% by weight |
| Asphaltenes n-$C_7$ | 7.5% by weight |
| Conradson Carbon | 14% |
| Operating Conditions | |
| Additive - 500 ppm of nickel + 2% DMDS | |
| Temperature 465° C. | |
| Nitrogen pressure 8 bars | |

The results summarised in table 2 show a gain in light fractions principally constituted by gasoline.

EXAMPLE 3

Viscoreduction of a vacuum Safaniya residue. Characteristics of the charge: Fraction 500° C.+ of a Safaniya crude.

| | |
|---|---|
| Asphaltene n-$C_7$: | 9% |
| Conradson Carbon: | 19% |
| Operating Conditions: | |
| Temperature: | 470° C. |
| Nitrogen pressure: | 8 bars |
| Additive 500 ppm of nickel + 2% DMDS | |

The results summarised in table 3 show a gain in light fractions. But the invention is not limited to the examples described. On the contrary is embraces all variants, in so far as these concern the choice of metal compounds and the treatment process for the hydrocarbon charge.

TABLE 2

| | With Additive | Without Additive |
|---|---|---|
| Yield 150° C.− | 1.6% | 1.4% |
| Yield 150–350° C. | 26.2% | 22.9% |
| Yield 350–440° C. | 12.8% | 10.3% |
| 440° C. | 59.0% | 65.0% |
| Asphaltene n-$C_7$ | 10% | 9% |
| Conradson Carbon | 14% | 14% |

TABLE 3

| | Without Additive | With Additive |
|---|---|---|
| Yield | | |
| 170° C.− | 2.7% | 3.2% |
| 170–350° C. | 6.9% | 9.8% |
| 350–440° C. | 5.9% | 6.3% |
| 444° C. | 84.5% | 80.7% |
| Asphaltene n-$C_7$ | 13% | 13% |
| Conradson Carbon | 21% | 22% |

We claimed:

1. A process for reducing coke formation during a liquid phase thermal treatment of a hydrocarbon charge having a high asphaltene content, which comprises forming a liquid admixture of the hydrocarbon charge and a coke formation inhibiting amount of from 100 to 2500 ppm of at least one metal compound, said metal selected from the group consisting of V, Mo, Cr, W, Fe, Co and Ni and thermally treating the admixture in a liquid phase at a temperature from 350° C. to 500° C. and a pressure of from 1 to 100 bars.

2. A process according to claim 1 wherein the at least one metal compound is a sulphide in suspension in the charge.

3. A process according to claim 1 wherein the at least one metal compound is selected from the group consisting of naphthenates and resinates and is added to the liquid charge as a solution or emulsion.

4. A process according to claims 1 2 or 3 comprising further adding to the charge 0.05 to 5% by weight of an organic sulphur compound having sulphur groups, in addition to the at least one metal compound.

5. A process according to claims 1, 2 or 3 wherein the temperature of the thermal treatment is between 400° and 500° C.

6. A process according to claim 1 wherein the process temperature is between 400° and 500° C.

7. A process according to claims 1, 2 or 3 wherein the pressure is due partially to hydrogen.

8. A process according to claims 1, 2 or 3 wherein the pressure is due partially to water vapour.

9. A process according to claims 1, 2 or 3 wherein the pressure is due partially to nitrogen.

10. A process according to claims 1, 2 or 3 wherein the pressure is between 5 and 25 bars.

11. A process according to claim 4 wherein the organic sulphur compound is dimethyldisulphide.

12. A process according to claim 4 wherein the sulphur compound is disulphide.

13. A process according to claim 4 wherein the sulphur compound is a polysulphide.

* * * * *